United States Patent [19]

Schülke

[11] Patent Number: 4,653,650

[45] Date of Patent: Mar. 31, 1987

[54] RACK FOR SUPPORTING WAFERS FOR TREATMENT

[75] Inventor: Karl A. Schülke, Neuberg, Fed. Rep. of Germany

[73] Assignee: Heraeus Quarzschmelze GmbH, Hanau, Fed. Rep. of Germany

[21] Appl. No.: 790,326

[22] Filed: Oct. 23, 1985

[30] Foreign Application Priority Data

Nov. 2, 1984 [DE] Fed. Rep. of Germany ..... 3440111

[51] Int. Cl.[4] ..... A47G 19/08

[52] U.S. Cl. ..... 211/41; 206/454; 118/500

[58] Field of Search ..... 211/41, 40; 206/454, 206/444, 445, 564, 316, 309; 118/500, 728, 729

[56] References Cited

U.S. PATENT DOCUMENTS

| | | | |
|---|---|---|---|
| 2,297,081 | 9/1942 | Slough | 211/40 |
| 2,488,535 | 11/1949 | Hamburg | 211/41 |
| 3,610,613 | 10/1971 | Worden | 211/41 |
| 3,926,305 | 12/1975 | Wallestad | 211/41 |
| 3,949,891 | 4/1986 | Butter et al. | 211/41 |
| 4,098,923 | 7/1978 | Alberti et al. | 118/500 |
| 4,176,751 | 12/1979 | Gillissie | 211/41 |
| 4,228,902 | 10/1980 | Schulte | 211/41 |
| 4,256,229 | 3/1981 | Lee | 211/41 |
| 4,318,749 | 3/1982 | Mayer | 211/41 |
| 4,493,418 | 1/1985 | Johnson | 118/500 |
| 4,520,428 | 5/1985 | Lusk | 211/41 |
| 4,520,934 | 6/1985 | Aigo | 118/500 |
| 4,567,452 | 2/1986 | Schulke | 211/41 |

*Primary Examiner*—Richard J. Scanlan, Jr.
*Assistant Examiner*—Douglas W. Hanson
*Attorney, Agent, or Firm*—Felfe & Lynch

[57] ABSTRACT

A rack for supporting wafers has a pair of parallel struts with kerfs therealong for supporting the wafers. A dummy wafer is attached to the struts near each end of the struts to connect the struts structurally as the rack and serve as rack-handling handles. The dummy wafers are parallel to the adjacent kerfs and thus the wafers therein and dimensioned similarly to the wafers for providing favorable gas and heat distribution when a wafer loaded rack is placed in a furnace. This adapts the rack for diffusion treatment of semiconductor wafers.

10 Claims, 4 Drawing Figures

RACK FOR SUPPORTING WAFERS FOR TREATMENT

BACKGROUND OF THE INVENTION

The invention relates to a rack for supporting wafers for treatment and, in particular, semiconductor substrate wafers for a gas and heat diffusion surface treatment.

Racks for supporting circular semiconductor substrate wafers for treatments are known from German design patent publication No. 80 21 868, for example. German patent publication No. 3,624,751 discloses another such supporting rack in the form of a trough-like supporting body with slot-like kerfs in its bottom and in the upper edges of its side walls in which individual semiconductor substrate wafers are inserted.

When loaded with semiconductor substrate wafers, such racks are put into horizontally-operated diffusion furnaces for heat and gas treatment of the surfaces of semiconductor substrate wafers. To facilitate handling for this, it has long been the practice to make the racks relatively short, typically with a length of 150 mm and a capacity for 25 or 50 wafers. The usual diffusion furnace holds from three to seven such racks at a time.

Also to facilitate handling in putting such racks into a furnace, the ends of the racks have had handles. The space required for the handles has resulted in more space between the rack-end substrate wafers in successive racks placed end to end in the furnace than between the substrate wafers in either of the racks. This has resulted in non-uniform gas and heat flow about the substrates in the furnace and, thus, non-uniform gas and heat treatment of the rack-end wafers in the furnaces as compared to wafers not at the ends of either of the end-to-end racks. The extra, handle-caused end spacing between end-to-end racks also was wasted, giving the racks an unfavorable useful-to-total length ratio.

SUMMARY OF THE INVENTION

An object of the invention is, therefore, to provide a wafer-supporting rack conducive to a favorable, uniform heat and gas flow pattern in a furnace and corresponding wafer treatment.

Another object is to provide such a rack in which the useful-to-total length ratio is greater than in prior-art racks.

These and other objects are achieved with a dummy wafer attached near one end of a rack having slot-like kerfs successively along the rack therefrom for holding wafers in spaced relation to each other, the dummy wafer being substantially parallel to the adjacent slot-like kerf or kerfs and, therefore, the wafer held thereby. This allows the space between the dummy wafer and the wafer held by the adjacent kerf or kerfs to be preset for uniform gas and heat flow in a furnace and, thus, uniform treatment of each wafer in the rack, including the end wafer adjacent the dummy wafer.

The dummy wafer can also serve as part of rack structure at the rack end and a rack-end handle for placing the rack in the furnace. Because it is substantially parallel to the adjacent wafer, this saves space between end-to-end arranged racks and, therefore, increases the useful-to-total length ratio of the rack as compared to prior designs having separate rack-end structure and/or handles.

More particularly, a preferred embodiment has at least one longitudinal strut having successive, equallyspaced, parallel slot-like kerfs transversely of the strut, each for supporting a wafer orthogonally to the strut from an edge of the wafer, generally the lower edge of the wafer, loaded into the slot-like kerf. The dummy wafer is, then, similarly orthogonal to the strut and, preferably, commensurate with the other dimensions of the wafers, except that the dummy wafer is, in general, thicker than the wafers and, particularly, semiconductor substrate wafers for sufficient strength.

It has been found that uniform exposure to heat and gas is of decisive importance to the quality of semiconductor wafers treated in a diffusion furnace. Because the rack-end structure is a wafer-like dummy wafer, the wafer-spacing discontinuity at the transition from one rack to a next, end-to-end rack can be selected with the invention to overcome the nonuniformity drawback of the prior-art supporting racks.

Because the empty space in the transition region between two racks conventionally arranged end to end is occupied by the dummy wafers at the ends of the racks, a quasi-continuous array of wafers is obtained rack to rack which is conducive to a favorable flow pattern in the diffusion furnace. After the furnace treatment, the semiconductor wafers, whether located in the center of the rack or near the ends, are all of uniform quality.

Having the dummy wafer handles at both ends of each rack the same size and shape as the semiconductor wafers achieves a particularly good flow pattern in a diffusion furnace. The dummy wafers therefore may be permanently attached directly to the ends of the rack, i.e. as part of the rack structure, without attendant loss of wafer quality. Further, because each dummy wafer is very thin, space becomes available for from one to four additional semiconductor wafers per rack in comparison to a conventional rack, assuming a total rack length corresponding to that of a conventional rack.

A rack of particularly simple and, therefore, preferred construction has two, parallel, transversely-slotted, longitudinal struts interconnected at their ends by dummy wafers that are in alignment with kerfs therealong and, thus, semiconductor substrates when inserted into the rack kerfs.

The longitudinal struts advantageously extend slightly beyond the outer, rack-end surfaces of the dummy wafers to space apart, automatically, the dummy wafers on two racks arranged end to end in a row. The portion of the struts projecting beyond the outer surface of each dummy wafer and/or a holding or handle feature thereon could have a length equal to one-half the clearance between the dummy wafer and the slot for the substrate wafer next to the other side of the dummy wafer along the rack. However, because the thickness of the dummy wafers generally must be greater than that of the semiconductor wafers intended for the rack for sufficient strength, the spacing between the last semiconductor wafer and the dummy wafer, and between dummy wafers of successive end-to-end racks, is advantageously made larger than that between adjacent wafers in proportion to the greater mass of the dummy wafer to achieve some measure of mass continuity along the end-to-end racks.

For aid in handling the racks from the dummy wafers, short, cylindrical or, especially, loop-type extensions from the outer rack-end surfaces of the dummy wafers have proved suitable and are, therefore, preferred. So that these extensions do not get in the way of arranging the racks end to end in a row, a recess or aperture is advantageously formed in each dummy wafer at a point corresponding to the extension on the dummy wafer of the next rack for receiving the extension from the other rack. As an alternative, the lower faces of the dummy wafers on one rack may be horizontally-extending abutment surfaces to be straddled by two prongs of a fork on another rack, for example. In this regard, therefore, the racks for end-to-end use in a furnace differ from each other on their ends, for example by oppositely-facing, asymmetrical elevations, to provide the cooperative handle-aid extension and space-saving receiver.

BRIEF DESCRIPTION OF THE DRAWING

Further details and advantageous measures of the invention will be apparent from the following description of merely-illustrative, preferred embodiments shown in drawings, wherein.

DETAILED DESCRIPTION OF THE INVENTION

Figure 1:
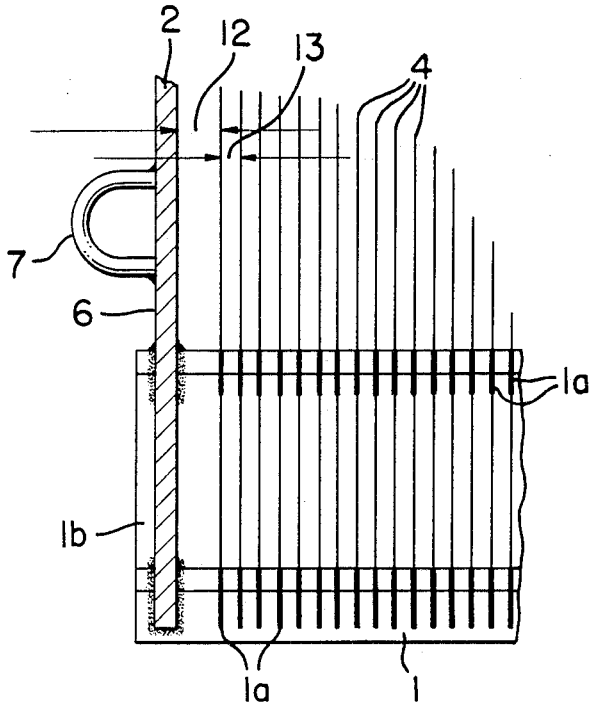
FIG. 1 is an enlarged side elevation of a portion of one preferred embodiment, partly in section.
Figure 2:
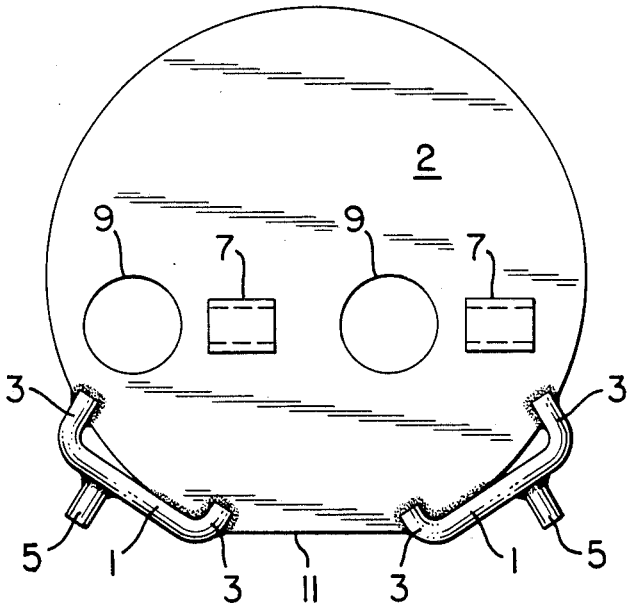
FIG. 2 is an end view of the embodiment shown in FIG. 1.
Figure 3:
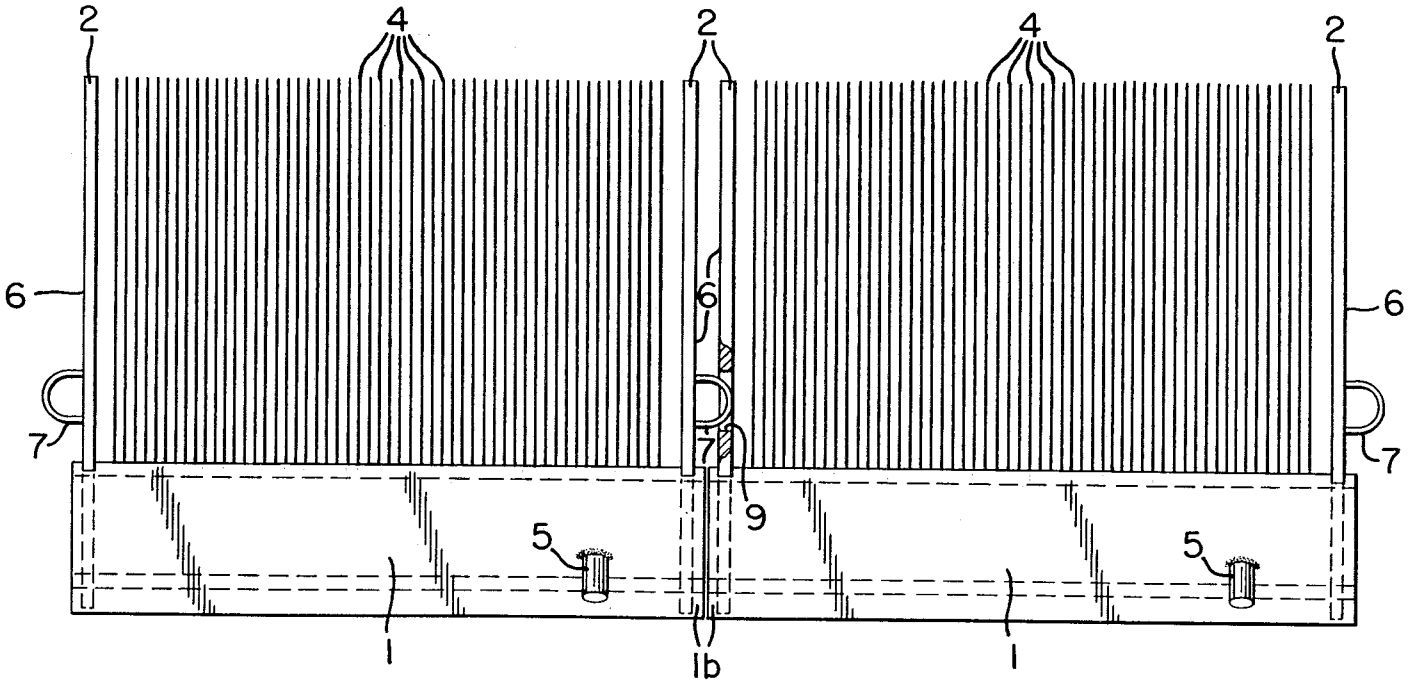
FIG. 3 is a side elevation of two of the embodiments shown in FIGS. 1 and 2 abutting each other end to end.

As may be seen from FIGS. 1 to 3, a rack for supporting round semiconductor substrate wafers 4 has two, spaced, parallel, mirror-image, struts 1 of a ceramic material. The struts are transversely interconnected only near their ends by two, oppositely-facing, identical but asymmetric dummy wafers 2 welded to the longitudinal struts. In FIGS. 1 and 2, the fillets where the dummy wafers 2 are welded to the longitudinal struts 1 are shown as wavy hatching. The dummy wafers 2 thus form part of the rack structure. They also serve as handles for handling the rack.

In this embodiment, the longitudinal struts 1 have chevron-arranged, U-shaped cross sections (FIG. 2) with end, flange sections 3 of the U shape of each strut extending inwardly for holding the semiconductor wafers 4 in transverse, aligned, parallel, slot-like kerfs 1*a* regularly spaced therealong. A stud 5 extends from each longitudinal strut oppositely to the end, flange sections 3 of the U-shaped cross section like a leg to support the rack on a supporting arrangement (not shown) in a diffusion furnace.

Figure 4:
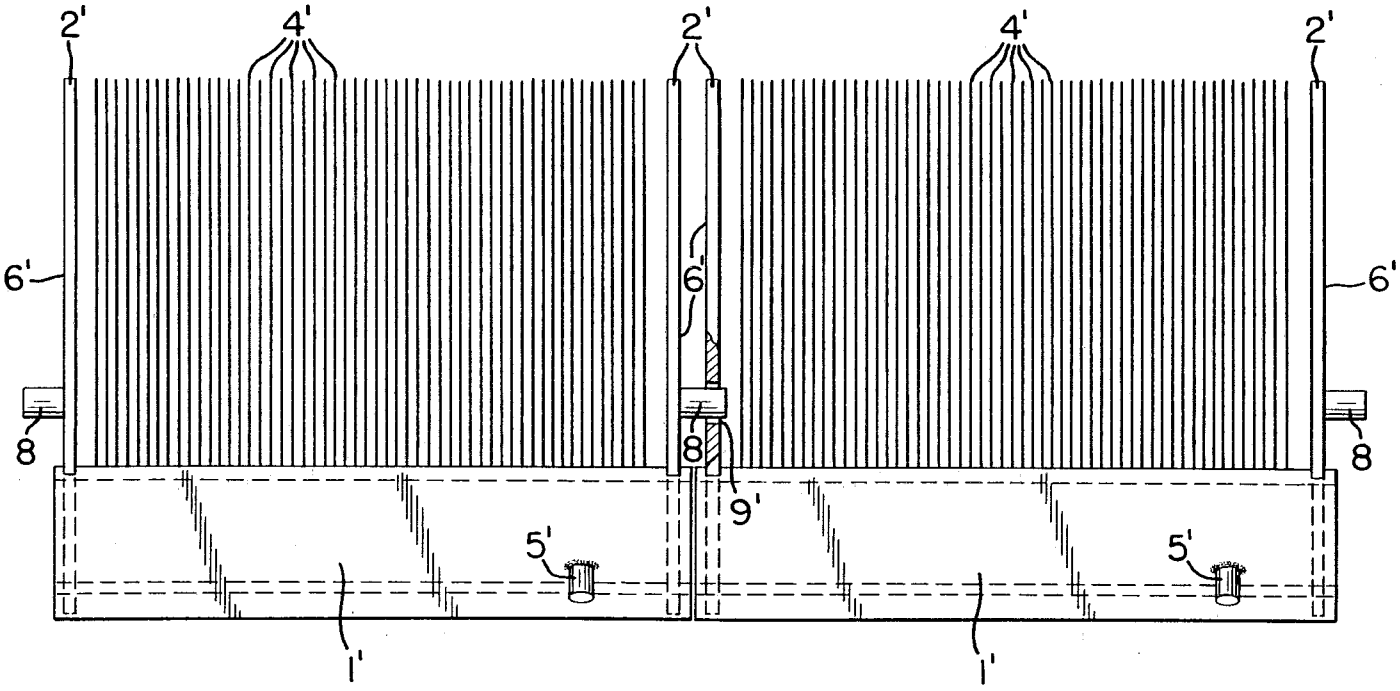
FIG. 4 is a side elevation corresponding to FIG. 3 but of another preferred embodiment.

By having the dummy wafers 2 only near the ends of the rack, the projections 1*b* of the struts beyond their outer surfaces 6 automatically set the reaction space of a diffusion furnace when two or more such wafer-loaded racks are pushed into a furnace end-to-end in a row as shown in FIGS. 3 and 4. Also, by having the dummy wafers 2 the same size, areawise, as the semiconductor wafers 4 and spacing them from the next adjacent semiconductor-wafer kerfs 1*a*, as well as from each other with the strut projection 1*b*, appropriately relative to their greater thickness as compared to the semiconductor wafers, quasi-continuity is obtained with respect to mass as though semiconductor wafers were continuously along end to end racks without a break between the racks. These features contribute to uniform gas and heat treatment in a diffusion furnace.

To permit the racks to be handled by an implement as desirable for heat and sterile safety, loop extensions 7 are permanently attached to the outer surface 6 of each dummy wafer 2 in the embodiment of FIG. 3 and cylinder sections 8, in the embodiment of FIG. 4. Because the handling extensions 7 or 8 project from the outer surfaces 6 of the dummy wafers 2 more than the spacing between two, end-to-end racks provided by the strut projections 1*b* from the dummy wafers 2, apertures 9 are provided at appropriate points in each dummy wafer for receiving the extensions 7 or 8 of adjacent dummy wafer. This makes it necessary for the extensions 7, 8 to be offset on successive dummy wafers of end-to-end racks asymmetrically as shown, for example. If the handling extension of a rack is located above the center of gravity of the loaded rack, one extension on each dummy wafer will suffice. If not, two such extensions 7 or 8 will be required on each dummy wafer as shown in FIG. 2.

In place of the handling extensions described above, the dummy wafers of another embodiment (not shown) may be flattened at their bottom 11 (FIG. 2) in such a way that a horizontally-extending abutment surface (not shown) for a handle is formed.

Whereas the semiconductor wafers 4 usually have a thickness of about 0.6 mm, the dummy wafers are made 2.7 mm thick to provide for adequate stability. To achieve mass continuity along the racks with dummy wafers so dimensioned, the separation, designated 12 in FIG. 1., between the dummy wafer and the adjacent wafer is made greater than the spacing 13 between two, adjacent, semi-conductor-wafer kerfs 1*a*.

It will be appreciated that the instant specification and claims are set forth by way of illustration and not of limitation, and that various changes and modifications may be made without departing from the spirit and scope of the present invention.

What is claimed is:

1. A rack for supporting wafers, comprising:

first and second parallel struts having kerfs for supporting wafers transversely therealong; and two dummy wafers, one dummy wafer transversely interconnecting the struts near each end of the struts substantially parallel to the adjacent kerfs, whereby each dummy wafer is substantially parallel to the wafer in the adjacent kerfs and forms at least part of the structure of the rack by joining the struts, each dummy wafer having an extension from the outer surface thereof on the side opposite the adjacent kerfs, the extensions on the dummy wafers being off set from each other, whereby the rack can be placed end to end with another such rack without interference between the extensions of the thereby adjacent dummy wafers and the extensions can be used as a handle for handling the rack.

2. The rack of claim 1, wherein the struts project from the outer surface of one of the dummy wafers.

3. The rack of claim 2, wherein the struts project from the outer surface of each dummy wafer.

4. The rack of claim 2, and further comprising means located in the outer surface of each dummy wafer in a position which would receive the extension of the other dummy wafer for receiving such an extension.

5. The rack of claim 3, whrein the extensions are cylindrical.

6. The rack of claim 3, wherein the extensions are loops.

7. The rack of claim 3, and further comprising means located in the outer surface of each dummy wafer in a position which would receive the extension of the other dummy wafer for receiving such an extension.

8. The rack of claim 5, and further comprising means located in the outer surface of each dummy wafer in a position which would receive the extension of the other dummy wafer for receiving such an extension.

9. The rack of claim 6, and further comprising means located in the outer surface of each dummy wafer in a position which would receive the extension of the other dummy wafer for receiving such an extension.

10. The rack of claim 1, and further comprising means located in the outer surface of each dummy wafer in a position which would receive the extension of the other dummy wafer for receiving such an extension.

* * * * *

UNITED STATES PATENT AND TRADEMARK OFFICE

CERTIFICATE OF CORRECTION

PATENT NO. : 4,653,650

DATED : March 31, 1987

INVENTOR(S) : Karl A. Schulke

It is certified that error appears in the above-identified patent and that said Letters Patent is hereby corrected as shown below:

Column 1, line 13, "3,624,751" should be -- 30 24 751 --.

Signed and Sealed this

Twentieth Day of September, 1988

*Attest:*

DONALD J. QUIGG

*Attesting Officer*

*Commissioner of Patents and Trademarks*